US011326127B2

(12) United States Patent
Acharya et al.

(10) Patent No.: US 11,326,127 B2
(45) Date of Patent: May 10, 2022

(54) FOAMABLE CLEANING COMPOSITION COMPRISING AN ALKOXYLATED ANIONIC/NONIONIC SURFACTANT MIXTURE

(71) Applicant: Conopeo, Inc., Englewood Cliffs, NJ (US)

(72) Inventors: Koushik Acharya, Bangalore (IN); Narayanan Subrahmaniam, Bangalore (IN)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 17/273,622

(22) PCT Filed: Aug. 7, 2019

(86) PCT No.: PCT/EP2019/071192
§ 371 (c)(1),
(2) Date: Mar. 4, 2021

(87) PCT Pub. No.: WO2020/048715
PCT Pub. Date: Mar. 12, 2020

(65) Prior Publication Data

US 2021/0317383 A1 Oct. 14, 2021

(30) Foreign Application Priority Data

Sep. 5, 2018 (EP) ..... 18192724

(51) Int. Cl.

| | |
|---|---|
| ***C11D 1/83*** | (2006.01) |
| ***C11D 1/72*** | (2006.01) |
| ***C11D 1/94*** | (2006.01) |
| ***C11D 3/00*** | (2006.01) |
| ***C11D 3/20*** | (2006.01) |
| ***C11D 3/43*** | (2006.01) |
| ***C11D 11/00*** | (2006.01) |

(52) U.S. Cl.
CPC ..... *C11D 1/83* (2013.01); *C11D 1/72* (2013.01); *C11D 1/94* (2013.01); *C11D 3/0094* (2013.01); *C11D 3/2075* (2013.01); *C11D 3/43* (2013.01); *C11D 11/0017* (2013.01)

(58) Field of Classification Search
CPC .... C11D 1/29; C11D 1/72; C11D 1/83; C11D 3/0094; C11D 3/2068; C11D 7/08; C11D 7/263; C11D 9/446; C11D 11/0017; C11D 17/08
See application file for complete search history.

(56) References Cited

U.S. PATENT DOCUMENTS 5,840,676 A 11/1998 Drapier
6,268,330 B1 * 7/2001 Leonard ..... C11D 1/83 510/432
6,521,578 B1 * 2/2003 Stute ..... C11D 1/86 510/191
6,551,984 B1 * 4/2003 Arvanitidou ..... C11D 3/382 510/463
8,617,317 B1 12/2013 Levitt
2003/0027737 A1 * 2/2003 Evers ..... C11D 1/94 510/357
2003/0224960 A1 * 12/2003 Scialla ..... C11D 3/3947 510/302
2003/0228272 A1 12/2003 Amjad et al.
2004/0138090 A1 * 7/2004 Drapier ..... C11D 3/48 510/506
2006/0130246 A1 * 6/2006 Molenda ..... C11D 3/0089 8/405
2012/0177746 A1 * 7/2012 Ramirez ..... A61P 31/04 424/616

(Continued)

FOREIGN PATENT DOCUMENTS

CN 107787356 A 3/2018
EP 1700619 A1 9/2006

(Continued)

OTHER PUBLICATIONS

International Search Report dated Oct. 10, 2019 for corresponding International Application No. PCT/EP2019/071192 (7 pages).

(Continued)

*Primary Examiner* — Charles I Boyer

(74) *Attorney, Agent, or Firm* — Carter, DeLuca & Farrell LLP; George Likourezos

(57) ABSTRACT

A foamable, liquid cleaning composition comprising: i. 0.5 to 5 wt. % $C_{8-18}$ alkoxylated anoionic surfactant having 1 to 30 moles of alkylene oxide; ii. 5 to 20 wt. % nonionic surfactants; iii. 0.1 to 10 wt. % water miscible glycol ether solvent; iv. 0.1 to 10 wt % water immiscible fatty acid ester solvent selected from the group consisting of methyl laurate, ethyl laurate, ethyl octanoate or mixtures thereof; v. 0.1 to 10 wt % of sequestrant selected from the group consisting of citric, adipic, succinic, maleic, glutaric acids, mixtures thereof or salts thereof; and vi. water, wherein the composition has a viscosity of less than 100 mPa·s at 25° C. and 20 $s^{-1}$, wherein ratio of the sum of alkoxylated surfactant (i) and nonionic surfactant (ii) to the solvent is in a weight ratio ranging from 0.93:1 to 20:1, and wherein the pH of the composition ranges from 2.0 to 4.5. A cleaning system comprising a spraying device and a foamable liquid cleaning composition, said spraying device forming a foam with a density of less than 0.4 g/ml when ejected from the spray device through the spray head. A method of removing oily fatty stains from fabric. Use of the composition for the removal of oily fatty stains from fabric, said use comprising applying the liquid cleaning composition in the form of a foam onto the surface of the fabric.

12 Claims, No Drawings

(56) References Cited

U.S. PATENT DOCUMENTS

| | | | | |
|---|---|---|---|---|
| 2013/0196890 | A1* | 8/2013 | Post | C11D 3/48<br>510/363 |
| 2014/0155454 | A1* | 6/2014 | Gengler | C11D 3/3947<br>514/417 |
| 2016/0137955 | A1* | 5/2016 | Leipold | C11D 3/2075<br>510/351 |

FOREIGN PATENT DOCUMENTS

| | | | |
|---|---|---|---|
| WO | 2008127803 | A1 | 10/2008 |
| WO | 2014016134 | A1 | 1/2014 |
| WO | 2016202572 | A1 | 12/2016 |
| WO | 2017087261 | A1 | 5/2017 |
| WO | 2017214244 | A1 | 12/2017 |
| WO | 2017215932 | A1 | 12/2017 |

OTHER PUBLICATIONS

European Search Report dated Feb. 25, 2019 in corresponding European Patent Application No. 18192724.5 (10 pages).

* cited by examiner

FOAMABLE CLEANING COMPOSITION COMPRISING AN ALKOXYLATED ANIONIC/NONIONIC SURFACTANT MIXTURE

The present application is a national phase filing under 35 USC 371 of International Application No. PCT/EP2019/071192, filed on Aug. 7, 2019, which claims priority from European Patent Application No. 18192724.5, filed on Sep. 5, 2018, the contents of which are incorporated herein in their entirety for all purposes.

FIELD OF THE INVENTION

The present invention relates to a pre-treatment composition for cleaning of fabrics. In particular, the present invention pertains to a sprayable foamable liquid cleaning composition.

BACKGROUND OF THE INVENTION

Removal of stains from fabric can be a challenge. Washing stained fabric with a detergent may produce satisfactory results if the stains are light and not greasy. However, if the stains are heavy, washing with detergent often does not remove the stains because the detergent ingredients are diluted in the wash and are not concentrated on to the stain.

To successfully remove heavy stains, it is known in the art to apply a separate stain treatment pre-wash, e.g., by spraying or squirting a stain treatment product directly on the stain or using a wipe impregnated with a stain treatment product to scrub a stain.

Sprayable cleaning compositions have been in use for many years for both household and industrial cleaning of a variety of organic and inorganic soils, such as food residue, soap scum, grease, hardness components, and the like. Commonly these cleaners comprise a major proportion of a solvent such as water or a mixed aqueous-organic solvent. These spray compositions are usually formulated at a near-neutral pH (about 7) or an alkaline pH (up to about 12).

One such light duty liquid detergent composition with high foaming properties is disclosed in U.S. Pat. No. 5,840,676 which relates to a novel microemulsion having a non-ionic surfactant, a $C_8$ to $C_{18}$ ethoxylated alkyl ether sulfate anionic surfactant, sulfonate or sulfonate anionic surfactant and a betaine surfactant and a pH of 5 to 8 which is effective in removing grease soils.

More recently WO 2017/087261 A1 discloses a cleaning product that has a spray dispenser and a cleaning composition having surfactant system, glycol ether and a cleaning amine to provide improved cleaning. The surfactant system of the cleaning composition has a combination of anionic surfactant and a co-surfactant selected from betaine, amine oxide and mixtures thereof, such that the weight ratio of surfactant system and the glycol ether in the cleaning composition is from about 5:1 to about 1:1 and the cleaning composition has a pH of greater than 8.

The prior art cleaning composition perform adequately on many soils, however in certain applications neutral or basic cleaning composition have the disadvantage that certain soils can be very difficult to clean, as these soils are less soluble at a basic pH. An acidic cleaning composition is indicated for soil removal in these instances.

WO 2008/127803 A1 discloses a cleaning composition having an anionic surfactant, lactic acid, a non-ionic surfactant, hydrogen peroxide and water. There is also provided a composition further having an amphoteric surfactant and a glycol ether solvent. The cleaning composition has a pH of 3 to 4 and is a foamable composition within a bottle having a nozzle and a spray pump dispenser and provides cleaning or removing mineral deposits, bleachable stains or soil from fabrics. The glycol ether solvent is present in amounts ranging from 1 to 4 wt. % of the composition.

US 2014/0228272 A1 discloses a cleaning composition having a non-ionic surfactant, glycol ether, and an ester solvent. The pH of the formulation is between 8 to 12. The formulation claims to clean greasy stains.

Acidic cleaning compositions have the drawback that when sprayed, such cleaners create an acidic mist or fog, which can cause eye irritation and damage. Similarly, if inhaled, the acidic mist or fog, can cause nose and throat irritation and coughing. If inhaled in sufficient amounts such cleaners could result in lung damage. For these reasons, sprayable liquid cleaning composition within acidic pH ranges have not drawn the kind of attention that has been given to the development of sprayable neutral or basic cleaning compositions.

However, a substantial need remains for an acidic liquid cleaning composition which can be used to efficiently remove a variety of soils including dirt, grease and body oil which are found on fabrics.

Foamable liquid compositions are a preferred form of pre-treatment compositions. Foams provides a visible indication of the parts of the substrate or surface to which the cleaner has been applied. More importantly, foam clings to the surface and prevents run-off, thereby minimising the quantity of surfactant containing product which is required and consequently minimising both cost and the release of surfactants into the environment. Overall, foamable compositions afford multiple benefits. These can be applied at lower dosages, enabling targeted applications of the composition directly on to the stained portion of the fabric, and require compact packaging as compared to a liquid composition.

Despite the advantages inherent to foamable acidic cleaning compositions, few have been disclosed to date. Most likely, this can be attributed to the fact that the strong acids thought to be necessary for effective cleansing power, both destabilize foam, and degrade the surfactants necessary to foam the composition.

Solvents in cleaning compositions provides better removal of the oily fatty stains. Increasing the levels of solvent in the pre-treatment composition may improve the efficacy of pre-treatment composition on several types of stains. To improve the removal of oily fatty stains it is desired to provide stable isotropic compositions with high solvent concentrations. Further, it is also desirable that such compositions be stable in presence of bleach and also be foamable.

In the past, there have been disclosures of cleaning composition with solvent added in a micro emulsion format, however these micro emulsion compositions stability issues and their preparation requires complicated processing steps. Moreover, these compositions may include around 1 to 20 wt. % of the solvent. However, addition of solvent at higher levels leads to phase separation.

Considering the above, there exists a need for a relatively stable foam composition on application to a surface or a substrate. Such foamable compositions must be an isotropic composition, and provide improved stain removing benefits at lower dosage of the total composition and at the same time be efficacious in removing a variety of stain types. While several foamable liquid cleaning composition meeting many of these needs separately have been marketed or suggested in literature, a need exists for a foamable detergent composition, which combines all the aforementioned benefits along with the advantages of an acidic pH, and incorporates higher levels of water miscible solvent, and at the same time is isotropic and provides stable foam.

Accordingly, it is an object of the present invention to provide a spray-able foamable liquid cleaning composition for the pre-treatment of fabric which provides for superior soil removal properties for a wide variety of stains.

It is also an object of the present invention to provide a spray-able foamable liquid cleaning composition for the pre-treatment of fabric which provides for superior soil removal properties for fatty stains.

Another object of the present invention is to provide a laundry pre-treatment composition containing both water and a water miscible solvent which forms into a clear homogeneous isotropic liquid and that allows for uniform dosing in dispensing.

It is thus an object of the present invention to provide a foamable cleaning composition which provides stable foam with desirable structure and characteristics and a foam density of less than 0.4 g/ml. Such foams with liquid fraction not more than 40% ensures foam integrity and stability and allows foams to cling properly to the surface and not spread immediately.

It is yet another object of the present invention to provide a foamable cleaning composition having a pH of 5 or less than 5 which provides good stain removal benefits without compromising on the stability of the isotropic solution or foam structure.

It is yet another object of the present invention to provide a foamable cleaning composition having higher levels of water miscible solvent without impacting the isotropic nature of the composition and the foam structure.

It is surprisingly found that an acidic foamable, liquid cleaning composition comprising $C_{8-18}$ alkoxylated surfactant, nonionic surfactants, water miscible solvent glycol ether, water immiscible fatty acid ester solvent and a sequestrant, having a viscosity of less than 100 mPa·s at 25° C. and 20 $s^{-1}$, provides both good cleaning on fatty stains and other stains in specified ratios of the sum of alkoxylated surfactant and nonionic surfactant to the solvent.

SUMMARY OF THE INVENTION

The present invention pertains to a foamable liquid composition providing a stable foam. The composition disclosed herein exhibits dilutability, homogeneity in solution, excellent cleaning performance on a variety of stain types. The composition of the present invention can be prepared with higher levels of solvents combined with specific amounts of alkyl alkoxylated anionic surfactant, nonionic surfactant, amphoteric surfactant and at specific ratios between the surfactant and solvents.

Accordingly, in a first aspect the invention provides a foamable, liquid cleaning composition comprising:

i. 0.5 to 5 wt. % $C_{8-18}$ alkoxylated anionic surfactant having 1 to 30 moles of alkylene oxide; preferably has 1 to 20 moles of ethylene oxide, more preferably 1 to 10 moles of ethylene oxide
ii. 5 to 20 wt. % nonionic surfactant;
iii. 0.1 to 10 wt. % water miscible solvent glycol ether;
iv. 0.1 to 10 wt. % water immiscible solvent fatty acid ester selected from the group consisting of methyl laurate, ethyl laurate, ethyl octanoate or mixtures thereof;
v. 0.5 to 10% of sequestrant selected from the group consisting of citric, adipic, succinic, maleic, glutaric acids, mixtures thereof or salts thereof; and
vi. water, wherein the cleaning composition has a viscosity of less than 100 mPa·s at 25° C. and 20 $s^{-1}$, wherein ratio of the sum of alkoxylated surfactant and nonionic surfactant to the solvent is in a weight ratio ranging from 0.93:1 to 20:1, and wherein the pH of the composition ranges from 2.0 to 4.5, preferably from 2.5 to 4.0.

In a second aspect, the invention provides a cleaning system comprising a spraying device and a foamable liquid cleaning composition, wherein the composition is according to the first aspect, said spraying device comprising a container holding the foamable liquid cleaning composition, a spray head, and a liquid supply arrangement for transferring the foamable liquid detergent composition from the container to the spray head and forming a foam with a density of less than 0.4 g/ml when ejected from the spray device through the spray head.

According to a third aspect, present invention provides a method of removing oily fatty stains from fabric, said method comprising the steps of:

i. providing a fabric;
ii. pre-treating the fabric by applying the aforementioned cleaning composition as a foam onto the surface of the fabric;
iii. washing the pre-treated fabric; and,
iv. drying the washed fabric.

In a fourth aspect the invention provides use of the composition, wherein the composition is according to the first aspect, for the removal of oily fatty stains from fabric, said use comprising applying the liquid cleaning composition in the form of a foam onto the surface of the fabric.

DETAILED DESCRIPTION OF THE INVENTION

As used herein, the terms "foamable" refers to a composition that is capable of forming foam and trapping gas bubbles in a liquid.

As used herein, the term "foam" refers to a substance that is made by forming and trapping gas bubbles in a liquid. A foam may be formed by injecting air into a foamable liquid composition and trapping the air and the dispensed foam has a density of less than 0.4 g/mL when ejected from a dispensing device for generating foam from a liquid. In particular, a foam can be formed by dispensing the liquid cleaning compositions described herein from a container (e.g., bottle or pump) such that the composition is mixed with gas bubbles, and the bubbles are trapped in the composition. Conventional devices for generating a foam from a liquid can be employed with the compositions and methods of the present invention.

The term "isotropic" means a single-phase composition that is clear or transparent, as assessed in absence of opacifiers, pigments, dyes, and the like. More particularly within aqueous liquid detergent compositions it means there is no discrete separate organic phase dispersed within the main aqueous phase. An isotropic composition is distinguished from water-in-oil emulsions, oil-in-water emulsions including microemulsions and lamellar phase compositions.

Unless specified otherwise, amounts as used herein are expressed in percentage by weight based on total weight of the composition and is abbreviated as "wt. %".

Accordingly, in a first aspect the invention provides a foamable, liquid cleaning composition comprising:

i) 0.5 to 5 wt. % $C_{8-18}$ alkoxylated anionic surfactant having 1 to 30 moles of alkylene oxide, preferably has 1 to 20 moles of ethylene oxide, more preferably 1 to 10 moles of ethylene oxide;

ii) 5 to 20 wt. % nonionic surfactant;

iii) 0.1 to 10 wt. % water miscible solvent glycol ether;

iv) 0.1 to 10 wt. % water immiscible solvent, fatty acid ester selected from the group consisting of methyl laurate, ethyl laurate, ethyl octanoate or mixtures thereof;

v) 0.5 to 10% of sequestrant selected from the group consisting of citric, adipic, succinic, maleic, glutaric acids, mixtures thereof or salts thereof; and vi) water, wherein the foamable, liquid cleaning composition has a viscosity of less than 100 mPa·s at 25° C. and 20 $s^{-1}$, wherein ratio of the sum of alkoxylated surfactant and nonionic surfactant to the solvent is in a weight ratio ranging from 0.93:1 to 20:1, and wherein the pH of the composition ranges from 2.0 to 4.5, preferably from 2.5 to 4.0.

Similarly according to a second aspect, the invention provides a cleaning system comprising a spraying device and the foamable liquid cleaning composition of the present invention, said spraying device comprising a container holding the foamable liquid cleaning composition, a spray head, and a liquid supply arrangement for transferring the foamable liquid detergent composition from the container to the spray head and forming a foam with a density of less than 0.4 g/ml when ejected from the spray device through the spray head.

Likewise, according to a third aspect, present invention provides a method of removing oily fatty stains from fabric, said method comprising the steps of:

(i) providing a fabric;

(ii) pre-treating the fabric by applying a liquid cleaning composition of the present invention as a foam onto the surface of the fabric;

(iii) washing the pre-treated fabric; and, (iv) drying the washed fabric.

In a fourth aspect the invention provides use of the composition of the present invention for the removal of oily fatty stains from fabric, said use comprising applying the liquid cleaning composition in the form of a foam onto the surface of the fabric.

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description indicating amounts of material or conditions of reaction, physical properties of materials and/or use are to be understood as modified by the word "about". Numerical ranges expressed in the format "from x to y" are understood to include x and y. When for a specific feature multiple preferred ranges are described in the format "from x to y", it is understood that all ranges combining the different endpoints are also contemplated.

Foamable Liquid Cleaning Composition

The foamable liquid cleaning composition of the present invention has a viscosity of less than 100 mPa·s at 25° C. and 20 $s^{-1}$. The viscosity describes a fluid's internal resistance to flow (deformation) and may be thought of as a measure of fluid friction, simply put, the less viscous the fluid is, the greater its ease of movement (fluidity).

The viscosity of the compositions according to the invention is preferably between 1 to 100 mPa·s (at 25° C. and 20 revolutions $s^{-1}$), more preferably between 5 to 80 mPa·s, when measured with a Brookfield Viscometer (model No—LVDV). Spindle No. 02 and the revolutions per minute (RPM) is set to 10. The foamable liquid cleaning composition of the present invention typically has a viscosity of less than 75 mPa·s, more preferably of less than 50 mPa·s, most preferably less than 40 mPa·s at 25° C. and 20 $s^{-1}$.

The in-bottle pH of the foamable liquid cleaning composition of the present invention should be maintained as acidic composition, that is, having a pH of less than 5, preferably a pH in the range of 2.0 to 4.5, more preferably the pH is in the range of 2.5 to 4.0, most preferably in the range of 3.0 to 3.5.

The foamable liquid cleaning composition preferably forms a foam with a density of less than 0.4 g/ml, more preferably of 0.3 to 0.1 g/ml, most preferably 0.25 to 0.15 g/mL when ejected from the spray device through the spray head.

The foamable liquid cleaning composition of the present invention is used to treat stained regions of the fabric, prior to the usual laundering and washing process with common detergent compositions, to make the removal of the stain from those pre-treated areas in the subsequent washing process more effective. Such areas are, for example, collars, cuffs, brims of shirts, underwear, which may be heavily soiled with human sebum, as well as industrial clothing, which may become heavily soiled by external soil-sources, not only fats and oils, but also blood and the like.

Alkoxylated $C_{8-18}$ Anionic Surfactant

The foamable liquid cleaning composition of the present invention comprises 0.5 to 5 wt. % of an alkoxylated anionic surfactant.

The alkoxylated anionic surfactant has an alkyl group with carbon chain length $C_{8-18}$ and has 1 to 30 moles of alkylene oxide.

The alkoxylated anionic surfactant may have a normal or branched chain alkyl group containing lower ethoxy groups with two or three carbon atoms. A "normal" chain alkyl group is also referred to as a linear chain alkyl group in the art. A general formula of such surfactants is $RO(C_2H_4O)_x$, $SO_3^-M^+$ where R is an alkyl chain having from 8 to 22 carbon atoms, saturated or unsaturated, M is a cation which makes the compound water-soluble, especially an alkali metal, ammonium or substituted ammonium cation, and x averages from 1 to 30. Preferably R is an alkyl chain having from 8 to 18 carbon atoms, more preferably 8 to 16 carbon atoms, M is sodium and x averages from 1 to 30, more preferably x averages from 1 to 20, most preferably x averages from 1 to 10.

It is particularly preferred that the alkoxylated anionic surfactant is an ethoxylated anionic surfactant, preferably a sodium lauryl ether sulphate (SLES). This is a sodium salt of lauryl ether sulphonic acid in which the predominantly $C_{12}$ lauryl alkyl group is ethoxylated with an average of 1 to 30 moles of ethylene oxide per mole of lauryl alkyl, more preferably 1 to 20 moles of ethylene oxide per mole, most preferably 1 to 10 moles of ethylene oxide per mole of lauryl alkyl.

Other examples of suitable ethoxylated anionic surfactants that could be used in accordance with the present invention are $C_{12}$ to $C_{15}$ linear or branched primary alkyl triethoxy sulphate, sodium salt; n-decyl diethoxy sulphate, sodium salt; $C_{12}$ primary alkyl diethoxy sulphate, ammonium salt; $C_{12}$ primary alkyl triethoxy sulfate, sodium salt; $C_{15}$ primary alkyl tetraethoxy sulfate, sodium salt; mixed $C_{14}$ to $C_{15}$ linear primary alkyl mixed tri- and tetraethoxy sulfate, sodium salt; stearyl pentaethoxy sulfate, sodium salt; and mixed $C_{10}$ to $C_{15}$ linear primary alkyl triethoxy sulfate, potassium salt.

Preferably, the liquid composition according to the present invention includes 1 wt. % to 5 wt. % of the alkoxylated anionic surfactant. The amount of alkoxylated anionic surfactant in the liquid composition is preferably 1.5 to 5 wt. %, more preferably 2 to 5 wt. % of ethoxylated $C_{8-18}$ alkyl ether sulfate surfactant having 1 to 30 moles of ethylene oxide.

Even more preferably, the liquid cleaning composition contains least 1 wt. %, preferably 2 to 16 wt. % of ethoxylated $C_{8-18}$ alkyl ether sulfate surfactant having 1 to 20 moles of ethylene oxide. According to a particularly preferred embodiment, the foamable cleaning composition contains at least 1 wt. %, preferably 1 to 20 wt. % of ethoxylated $C_{10-14}$ alkyl ether sulfate surfactant having 1 to 30 moles of ethylene oxide. Yet more preferably, the composition contains at least 1 wt. %, preferably 2 to 16 wt. % of ethoxylated $C_{10-14}$ alkyl ether sulfate surfactant having 1 to 20 moles of ethylene oxide.

Most preferably, the liquid cleaning composition contains at least 1 wt. %, preferably 2 to 5 wt. % of ethoxylated lauryl ether sulfate surfactant having 1 to 10 moles of ethylene oxide.

Preferably the amount of alkoxylated anionic surfactant in the foamable liquid cleaning composition of the present invention is at least 1 wt. %, still preferably at least 2.5 wt. %, further preferably at least 3 wt. % and most preferably at least 5 wt. %, but typically not more than 5 wt. %, on the liquid cleaning composition.

Non-Ionic Surfactant

The foamable liquid cleaning composition of the present invention comprises 5 wt. % to 20 wt. % of a nonionic surfactant. Nonionic surfactants are characterized by the presence of a hydrophobic group and an organic hydrophilic group and are typically produced by condensation of an organic aliphatic or alkyl aromatic hydrophobic compound with ethylene oxide.

Usually, the nonionic surfactants are polyalkoxylated lipophiles wherein the desired hydrophile-lipophile balance (HLB) is obtained from addition of a hydrophilic alkoxy group to a lipophilic moiety. A preferred class of nonionic surfactants are the alkoxylated alkanols in which the alkanol is of 9 to 20 carbon atoms and wherein the number of moles of alkylene oxide (of 2 or 3 carbon atoms) is from 5 to 20. Of such materials, it is preferred to use those wherein the alkanol is a fatty alcohol of 9 to 11 or 12 to 15 carbon atoms and which contain from 5 to 8 or 5 to 9 alkoxy groups per mole. Also preferred are paraffin-based alcohols (e.g. non-ionic surfactants from Huntsman or Sassol). Preferably the non-ionic surfactant is selected from an alkoxylated linear alcohol, more preferably an ethoxylated linear alcohol.

Exemplary of such compounds are those in which the alkanol is of 10 to 15 carbon atoms and which contain about 5 to 12 ethylene oxide groups per mole, e.g. Neodol™ family or Tergitol family. These are condensation products of a mixture of higher fatty alcohols averaging about 12 to 15 carbon atoms with about 9 moles of ethylene oxide. The higher alcohols are primary alkanols. Preferably, the non-ionic surfactants are those in which the alcohol is of 10 to 15 carbon atoms and which contain about 5 to 12 ethylene oxide groups per mole, e.g. Neodol™ family or Tergitol family.

Another subclass of alkoxylated surfactants which may be used contain a precise alkyl chain length rather than an alkyl chain distribution of the alkoxylated surfactants. Typically, these are referred to as narrow range alkoxylates. Examples of these include the Neodol™-1 series of surfactants.

Other useful non-ionic surfactants are represented by the commercially well-known class of non-ionic surfactants sold under the trademark Plurafac™ from BASF. The Plurafac™ are the reaction products of a higher linear alcohol and a mixture of ethylene and propylene oxides, containing a mixed chain of ethylene oxide and propylene oxide, terminated by a hydroxyl group. Examples include $C_{13}$-$C_{15}$ fatty alcohols condensed with 6 moles ethylene oxide and 3 moles propylene oxide, $C_{13}$-$C_{15}$ fatty alcohol condensed with 7 moles propylene oxide and 4 moles ethylene oxide, $C_{13}$-$C_{15}$ fatty alcohol condensed with 5 moles propylene oxide and 10 moles ethylene oxide or mixtures of any of the above.

Another group of nonionic surfactants are commercially available as Dobanol™ which is an ethoxylated $C_{12}$-$C_{15}$ fatty alcohol with an average of 7 moles ethylene oxide per mole of fatty alcohol.

Preferably the amount of nonionic surfactant in the foamable liquid cleaning composition is at least 5 wt. %, more preferably at least 7.5 wt. % but typically not more than 10 wt. %, still preferably not more than 15 wt. % and most preferably not more than 20 wt. % based on the liquid foamable cleaning composition.

Preferably the amount of non-ionic surfactant in the foamable liquid cleaning composition is in the range of 5 to 20 wt. %, preferably in the range of 7.5 to 15 wt. % based on the liquid foamable cleaning composition.

Glycol Ether

Glycol ether of the present invention includes materials such as DOWANOL™ (trademark of The Dow Chemical Company) P and E series including both water soluble and water insoluble glycol ether or glycol ether ester, ethylene glycol mono n-butyl ether, ethylene glycol monomethyl ether, propylene glycol monomethyl ether, propylene glycol mono n-butyl ether (PnB), dipropylene glycol monomethyl ether, dipropylene glycol mono propyl ether (DPnP), dipropylene glycol mono n-butyl ether (DPnB), and diethylene glycol butyl ether (DB), propylene glycol mono phenyl ether, propylene glycol monomethyl ether acetate. However, P series glycol ethers are more preferred over E-series as they are more environmentally safe.

Preferred glycol ethers are selected on the basis of the Hansen solubility parameter. For stains that have arisen from a body fluid, sebum or common oily/fatty stains such as cooking oil/DMO, glycol ethers whose RED (RED means relative energy difference in Hansen Solubility Parameter (HSP) space) is less than 2 have been proven to show efficacy. RED i.e. relative energy differences, indicates the extent of solubility of a solute in a particular solvent. RED is a unit-less number which is essentially the ratio of $R_a/R_0$. In a 3 coordinate system $R_0$ is defined as the maximum interaction radius of a solute and $R_a$ is defined as the interaction radius for the respective solvent. RED is calculated using solubility parameters which consists of polar, dispersion and hydrogen bonding component of intermolecular interactions pertaining to both solvent and solute.

Dipropylene glycol n-butyl ether, Dipropylene glycol dimethyl ether and dipropylene glycol methyl ether acetate and hexyl carbitol are the most preferred.

The water miscible glycol ether is present in a concentration of 0.1% to 10% wt. %, more preferably 0.66% to 5% wt, %, by weight of the total composition.

Fatty Acid Ester

Fatty acid esters of the present invention have the formula:

$R^1CO_2R^2$ wherein $R^1$ represents an alkyl group having 6-15 carbon atoms and $R^2$ is an alkyl group, preferably a methyl or ethyl group.

The preferred esters are those where $R^1CO$ is relatively long chain fatty acyl group, i.e. where $R^1$ has 7 to 13 carbon atoms. In these compounds $R^2$ is preferably a methyl group.

Particularly preferred due to their performance and commercial availability are Methyl Laurate, ethyl laurate and ethyl octanoate.

The fatty acid ester is present in a concentration of 0.1% to 10% by weight, more preferably 0.33% to 5% by weight, most preferably from 1 to 4% by weight.

Water

The composition of the present invention is an aqueous composition comprising water. The composition is made up to 100 percent by adding water. The composition preferably comprises at least 12 wt. % water, more preferably contains 30 to 90 wt. %. Most preferably the cleaning composition contains 40 to 80 wt. % water.

Hydrogen Peroxide

The composition of the present invention preferably comprises hydrogen peroxide. Hydrogen peroxide is the simplest peroxide (a compound with an oxygen-oxygen single bond) and finds use as a strong oxidizer, bleaching agent and disinfectant.

Hydrogen peroxide may be present in the composition of the present invention in a concentration of 2 to 12 wt. %, preferably not more than 10 wt. %, more preferably not more than 8 wt. %, still more preferably not more than 7 wt. % but typically not less than 3 wt. %, preferably not less than 4 wt. %, more preferably not less than 5 wt. % by weight of the composition. Preferably, the amount of hydrogen peroxide present is in the range of 2 to 10 wt. %, more preferably 3 to 8 wt. %.

Without wishing to be bound by theory, it is thought that hydrogen peroxide acts as the oxidizing agent in the composition and is primarily responsible for the bleaching action, but the superior removal of other stains is achieved by the synergistic effect of hydrogen peroxide in combination with the water miscible solvent.

Buffers

The composition of the present invention preferably comprises buffer. The preferred buffering agent comprises a weak acid and a base. Preferably the buffering agent comprises a carboxylic acid and a base selected from ammonium or alkali metal hydroxides and/or organic amines can also be used. Ammonium hydroxide, sodium hydroxide are particularly preferred. Preferably, such a system will buffer the product at a pH of 2.0 to 4.5, more preferably from 2.5 to 4.0.

More preferably the buffering agent is a weak acid and its salt, even more preferably the acid is a weak organic acid. The presence of carboxylic acid as salts in the formulation rather than as the acid form is believed to lead to a better foam so it is preferred that the pH of the composition should be above the lowest $pK_a$ of the carboxylic acid present. Citric acid, the preferred carboxylic acid, has $pK_a$'s of 3.14, 4.77 and 6.39 and consequently pH above 3.14 are preferred. The preferred buffering agents are carboxylic acid in combination with its salts. Suitable examples include but are not limited to citric acid and citrate salt; other organic weak acids and their salts.

Sequestrants

Weak sequestrants in the form of organic polycarboxylic acids are preferred components of the compositions according to the present invention. The presence of these weak sequestrants improves cleaning performance. It is believed that these components sequester weakly bound calcium ions as well as certain transition metal ions like $Fe^{3+}$ ions which are involved in the attachment of soil to surfaces and thereby facilitate the removal of these soiling materials.

Strong sequestrants can also be present. However, sequestrants such as EDTA are less preferred for environmental reasons, as it has been suggested that such poorly biodegradable sequestrants can solubilise heavy metals from river-bottom deposits. Moreover EDTA and other strong sequestrants have a tendency to complex with the calcium present in the domestic water and prevent the formation of the de-foaming calcium soap.

Preferably, the sequestrant is selected from, citric, adipic, succinic, maleic, glutaric acids, mixtures thereof or salts thereof. Typical levels of sequestrant range from 0.5 to 10 wt. %, preferably 1 to 4 wt. % in the foamable liquid composition.

Most preferably, the citric acid or salts thereof perform the role of a sequestrant. Citric acid is a weak sequestrant for calcium, is available from renewable resources, and also is rapidly biodegradable.

Citric acid is particularly preferred as both the sequesterant and a component of the buffering agent, at preferable inclusion levels of 1 to 4 wt. % of the foamable liquid cleaning composition. Other suitable examples include phosphonates and sequestrants which complex with metal ions or transitional metal ions.

Cleaning System

According to a second aspect, the invention provides a cleaning system comprising a spraying device and the foamable liquid cleaning composition of the present invention, said spraying device comprising a container holding the foamable liquid cleaning composition, a spray head, and a liquid supply arrangement for transferring the foamable liquid detergent composition from the container to the spray head and forming a foam with a density of less than 0.4 g/ml when ejected from the spray device through the spray head.

Spraying Device

The spraying device of the present invention preferably comprises a container having an internal volume of 100 to 1,500 ml, more preferably of 150 to 1,200 ml, even more preferably 180 to 1000 ml and most preferably of 200 to 800 ml.

The spraying device preferably comprises a positive displacement pump that acts directly on the foamable liquid cleaning composition. The pump draws the liquid cleaning composition up into the liquid supply arrangement and transfers the liquid cleaning composition to the spray head, from which it is discharged in the form of a foam, preferably through a nozzle.

In the spraying device of the present invention, the dispensing of the liquid cleaning composition is preferably powered by a user's efforts, i.e. the liquid cleaning composition is not dispensed under pressure by simply actuating a valve and requires manual triggering. The spraying device employed in accordance with the present invention is preferably selected from a trigger spray foam bottle, a squeeze foam bottle and a foam pump. Most preferably the spraying device is a squeeze foam bottle or a foam pump.

In another preferred embodiment, the spray device is configured to mix the liquid cleaning composition with air before it is dispensed from the spray head.

A suitable foaming device is an on-pressurised foam container such as that described in U.S. Pat. No. 3,709,437.

The composition can be placed into the reservoir of a plastic squeeze bottle which contains a foaming spray head or other foam producing means. Squeezing the container causes the liquid cleaning composition to leave the reservoir and enter an air-mixing or foaming chamber via an internal dip tube. The foam produced in the foaming chamber is often passed through a homogenizing element interposed between the air-mixing chamber and the discharge orifice to homogenise and control the consistency of the discharged foam. Further compression of the foam discharges the foam from a discharge cap as a uniform non-pressurised aerated foam. Alternatively, the side walls of the container may be rigid and the dip tube may be fitted with a pump that is actuated by a push button. When composition is drawn by the pump through to the air mixing or foaming chamber, the desired foam is produced.

Other means for producing foams will be apparent to those skilled in the art. Means for producing aerated foams are further described in U.S. Pat. Nos. 4,511,486 and 4,018,364.

Method of Treating a Fabric

In a third aspect, the present invention relates to a method of removing oily fatty stains from fabric, said method comprising the steps of:

i. providing a fabric;

ii. pre-treating the fabric by applying the liquid cleaning composition of the present invention dispensed in the form of a foam onto the surface of the fabric;

iii. washing the pre-treated fabric; and iv. drying the washed fabric.

According to a particularly preferred embodiment, the foamable liquid cleaning composition is selectively applied as a foam onto stained areas of the fabric.

According to another preferred embodiment, the liquid cleaning composition is applied by spraying the liquid cleaning composition onto the fabric, especially using the cleaning system described herein.

Preferably, the step of washing the pre-treated fabric is carried out in an aqueous solution of a detergent composition having 2 to 80 wt. % surfactant.

Use of the Foamable Liquid Cleaning Composition

In a fourth aspect, the invention relates to the use of the foamable liquid cleaning composition of the present invention for the removal of stains, preferably oily fatty stains, from fabric, said use comprising applying the foamable liquid cleaning composition in the form of a foam onto the surface of the fabric.

Preferably, the foamable liquid cleaning composition is applied in the form of a foam onto the surface of the fabric by means of spraying, more preferably by spraying the liquid cleaning composition using a cleaning system as defined herein.

The invention is further illustrated by means of the following non-limiting examples.

EXAMPLES

Materials

Alkoxylated anionic surfactant=SLES paste (70%): Sodium lauryl ether sulphate (LES 70 2EO) procured from Galaxy Surfactants Non-ionic surfactant=Ethoxylated fatty alcohol-$C_{12}EO_7$ (100%) procured from Galaxy Surfactants, Tergitol 15-S-7 from Dow Chemicals Glycol ether=Hexyl Carbitol, Hexyl Cellosolve, di(propylene glycol) n-butyl ether, procured from Dow Chemicals, & Sigma Aldrich Fatty Acid Ester=methyl laurate, ethyl laurate, ethyl octanoate procured from Sigma Aldrich Sequestrant=Dequest 2010 (1-Hydroxyl ethylidene-1,1,-diphosphonic acid, HEDP, 59% solution): Procured from Thermphos, Switzerland Citric acid (used as is) procured from Merck India Sodium citrate dihydrate procured from Merck India Deionized water Control: Vanish® stain remover spray (Market sample, Imported from Brazil)

Process for Preparing Compositions

Each of the ingredients was added in the indicated amounts in a plastic container and was mixed using the conditions given bellow:

Mixer type: Overhead stirrer (Heidolph)

RPM: 200-500 rpm

Mixer blade type: Two Flat blades at 90 degree attached to a SS rod which was fitted to the motor.

Mixing time: 30 min for a 1 kg batch size.

Temperature: 25° C. (Lab temperature)

Product Format

The compositions were packed in trigger foam sprayer obtained from Guala Dispensing, Italy.

Process for Pre-Treating a Fabric

The stain monitor used for carrying out the study was a standard single stain monitors procured from SUV-TUV South East Asia Pvt Limited.

For all the compositions, approximately 0.4 ml of the composition was dispensed as a foam and applied on each stain with the help of the above-mentioned foam device. After 5 minutes of application of the liquid, the pre-treated fabrics were washed with Surf Excel matic powder (Top load) in top-loading washing machine (Samsung).

For control the stains on the standard single stain monitor were pre-treated with approximately 1.4 mL of the Vanish stain remover (Market sample) spray, followed by washing with Surf Excel matic powder (Top load) in top-loading washing machine (Samsung).

Washing Protocol

The pre-treated standard stain monitors were washed in a tergo-to-meter. Liquor volume was maintained at 500 ml and L/C at 50. Washing was done with Brazil OMO powder (ex. Hindustan Unilever Ltd, India) at 1.6 g/L dosage at 6° FH. A typical wash cycle comprised of soak, wash and two rinses. After washing was completed, the swatches were removed and then line-dried overnight.

Evaluation

SRI (stain removal index): SRI was used to evaluate the efficacy of each composition. SRI was measured for each stain using ArtixScan F1 (Innotech Scanner). The SRI values are calculated from the L, a, b values of blank and stained fabrics as follows:

For Blank (unstained) fabrics: $L_B$, $a_B$, $b_B$

For stained fabrics: $L_S$, $a_S$, $b_S$ $$\text{Delta } E=\sqrt{(L_s-L_B)^2+(a_s-a_B)^2+(b_s-b_B)^2}$$

SRI=100−Delta E

Delta SRI=SRI (Expt)−SRI (Control)

Viscosity Measurement: Viscosity of the foamable liquid composition was measured using Brookfield Viscometer (model No—LVDV). Spindle No. 02 was used for all the measurement. Approximately 200 ml of the foamable liquid composition was placed in a 250 ml beaker. The spindle was attached to the viscometer head, and it was dipped into the liquid till the mark. The motor was switched on and the RPM of the spindle was set at 10. The viscosity was noted down from the display. To check whether the viscosity value changed with RPM, RPM was increased to 20, and then 50 and the viscosity values were noted. Values with torque more than 20% were noted.

pH Measurement: pH of the foamable liquid was measured with a standard pH meter. The pH meter was calibrated for two points, pH 4 and pH 7. First, the probe was washed in demineralized water and then it was calibrated first with pH 4 buffer solution and then with pH7 buffer solution. Once it is calibrated then it was dipped into the test solution. Wait for some time to get a steady reading. The value was noted.

Example 1

TABLE 1

| Comparative vs Invention | | | | | | |
|---|---|---|---|---|---|---|
| | | Comparative 01 | Comparative 02 | Comparative 03 | Comparative 04 | Invention A |
| Non-Ionic Surfactant | Tergitol (15-S-7) | Vanish Market Product | 7.5 | 7.5 | 7.5 | 7.5 |
| Anionic Surfactant | Sodium lauryl ether sulphate | | 2 | 2 | 2 | 2 |
| Water Miscible solvent | Hexyl Carbitol | | | 5 | | 5 |
| Water Immiscible solvent | Solvent-Ethyl Octanoate | | | | 2.5 | 2.5 |
| Buffer | Citric Acid | | 0.12 | 0.12 | 0.12 | 0.12 |
| Buffer | Sodium Citrate | | 0.38 | 0.38 | 0.38 | 0.38 |
| Sequestrant | Dequest 2010 | | 1 | 1 | 1 | 1 |
| | Water | | 89.0 | 84.0 | 86.5 | 81.5 |

| | Comparative 01 | Comparative 02 | Comparative 03 | Comparative 04 | Invention A |
|---|---|---|---|---|---|
| Dosage | 1.35 ml | 0.4 ml | 0.4 ml | 0.4 ml | 0.4 ml |
| Viscosity (Brookfield Viscometer, Spindle S02) | 12 cP | 10 cP | 12 cP | 11 cP | 11 cP |
| pH | 3.5 | 3.1 | 2.7 | 2.8 | 2.8 |
| Foamability | Yes | Yes | Yes | Yes | Yes |
| Foam Density | NA | <0.4 | <0.4 | <0.4 | <0.4 |

The cleaning efficacy of those formulations were tested against vanish. For that, 1.35 ml of vanish was applied directly onto the test fabric and 0.4 ml of Invention A, were applied onto the stain. 5 min of aging time was provided before putting those into the washing machine. Standard detergent powder (surf excel quick wash) was used a 1.5 gpl product dosage. The washing was carried out in normal fuzzy wash cycle. After washing the test fabrics were dried in dark room and L, a, b values were measure and SRI was calculated based on the equation provided above.

| | No pre-treatment (only detergent) | Comparative 01 | Comparative 02 | Comparative 03 | Comparative 04 | Invention A |
|---|---|---|---|---|---|---|
| Cooking Oil | 78.3 | 84.51 | 86.1 | 88.7 | 91.22 | 94.53 |
| Dirty Motor Oil | 76.5 | 82.4 | 86.1 | 90.1 | 92.22 | 96.53 |
| Mechanical Grease | 69.8 | 75.2 | 82.1 | 84.5 | 94.1 | 97.8 |

From the result, it was very evident that the invention A, is far better than the market benchmark and any other solvent combination.

Example 2: Effect of pH

Foaming cleaning compositions were prepared on the basis of the recipes shown in Table 2 and pH of the formulations obtained, was maintained at 2.5, 5 and 8 by means of addition of buffer. The compositions were sprayed onto the stained fabric and the pre-treated fabric was washed after this treatment following the procedure described herein before. The results are summarized in Table below.

TABLE 2

Compositions at different pH conditions

| | Invention A | Comparative 05 | Comparative 06 |
|---|---|---|---|
| Tergitol (15-S-7) | 7.5 | 7.5 | 7.5 |
| Sodium lauryl ether sulphate | 2 | 2 | 2 |
| Hexyl Carbitol | 5.0 | 5.0 | 5.0 |
| Solvent-Ethyl Octanoate | 2.5 | 2.5 | 2.5 |
| Citric Acid | 0.12 | | |
| Sodium Citrate | 0.38 | 2.0 | 5.0 |
| Dequest 2010 | 1.0 | 1.0 | 1.0 |
| Water | 81.5 | 80.0 | 77.0 |

The pH of the formulations was measured by pH meter and viscosity was measured by Brookfield viscometer, and are noted below.

| | Invention A | Comparative 05 | Comparative 06 |
|---|---|---|---|
| pH | 2.8 | 5.01 | 8.0 |
| Viscosity (Brookfield viscometer, Spindle S02) | 11 cP | 18 cP | 35 cP |
| Foamability | Yes | Yes | Yes |
| Foam Density | <0.4 | <0.4 | <0.4 |

The cleaning evaluations were carried out and the result was given as follows.

| | Invention A | Comparative 05 | Comparative 06 |
|---|---|---|---|
| Cooking Oil | 94.53 | 92.5 | 90.3 |
| Dirty Motor Oil | 96.53 | 94.7 | 92.1 |
| Mechanical Grease | 97.8 | 95.6 | 91.4 |

The data in table shows that the composition according to the present invention having claimed pH values around 2.8 provides a liquid cleaning composition with improved stain removal benefits as compared to the comparative composition (05 and 06) having higher pH values.

Example 3: Effect of Sequestrant

To understand the effect of sequestrant, black tea, coffee with milk and tomato ketchup stain were taken. pH of the formulation maintained with 1% citric acid.

| | Invention A | Comparative 07 |
|---|---|---|
| Tergitol (15-S-7) | 7.5 | 7.5 |
| Sodium lauryl ether sulphate | 2 | 2 |
| Hexyl Carbitol | 5.0 | 5.0 |
| Solvent-Ethyl Octanoate | 2.5 | 2.5 |
| Citric Acid | 0.12 | 1.0 |
| Sodium Citrate | 0.38 | — |
| Dequest 2010 | 1.0 | — |
| Water | 81.5 | 81.0 |

pH of the formulation Comparative 07 was maintained to 3.0, with addition of 1% Citric Acid. Cleaning evaluation was carried out on Black Tea, Coffee with Milk, and on Tomato ketchup.

| Fabric | Black Tea | | Coffee with Milk | | Tomato Ketchup | |
|---|---|---|---|---|---|---|
| Type: Cotton | Avg. | Stdev | Avg. | Stdev | Avg. | Stdev |
| Invention A | 94.09 | 1.26 | 93.97 | 0.00 | 94.80 | 0.08 |
| Comparative 07 | 92.11 | 0.31 | 89.22 | 0.21 | 91.08 | 0.46 |

The difference of 2 SRI Unit is significant.

Example 4: Effect of Non-Ionic Surfactant

The amount of non-ionic surfactant present in the formulation will dictate the stability of the product as well as the cleaning efficacy. At a lower non-ionic level, the product will be unstable, which means, it will not be able to emulsify the solvents and at a very high non-ionic content, the viscosity of the formulation will be so high that it will not be able to foam. Compositions were made at different non-ionic level to check the efficacy.

| | Comparative 08 | Invention B | Invention A | Invention C | Invention D | Comparative 09 |
|---|---|---|---|---|---|---|
| Tergitol (15-S-7) | 2.00 | 5.00 | 7.50 | 15.00 | 20.00 | 25.00 |
| Sodium lauryl ether sulphate | 2.00 | 2.00 | 2.00 | 2.00 | 2.00 | 2.00 |
| Hexyl Carbitol | 5.00 | 5.00 | 5.00 | 5.00 | 5.00 | 5.00 |
| Solvent-Ethyl Octanoate | 2.50 | 2.50 | 2.50 | 2.50 | 2.50 | 2.50 |
| Citric Acid | 0.12 | 0.12 | 0.12 | 0.12 | 0.12 | 0.12 |
| Sodium Citrate | 0.38 | 0.38 | 0.38 | 0.38 | 0.38 | 0.38 |
| Dequest 2010 | 1.00 | 1.00 | 1.00 | 1.00 | 1.00 | 1.00 |
| Water | 87.00 | 84.00 | 81.50 | 74.00 | 69.00 | 64.00 |

The viscosity and pH of the formulations were measured along with foaming behaviour. The data is given below.

| | Comparative 08 | Invention B | Invention A | Invention C | Invention D | Comparative 09 |
|---|---|---|---|---|---|---|
| pH | 3.4 | 2.9 | 2.8 | 3.2 | 3.1 | 3.3 |
| Viscosity (Brookfield viscometer, Spindle S02) | 10 cP | 8 cP | 11 cP | 41 cP | 80 cP | 187 cP |
| Foamability | Unstable | Yes | Yes | Yes | Yes | No |
| Foam Density | Unstable | <0.4 | <0.4 | <0.4 | <0.4 | Non-Foaming |

The formulations were directly applied onto the stain and then those were washed as per the protocol given above. After cleaning, the L, a, b values were taken and SRI values were given in below table.

| | Comparative 08 | Invention B | Invention A | Invention C | Invention D | Comparative 09 |
|---|---|---|---|---|---|---|
| Cooking Oil | Un-stable | 92.1 | 94.53 | 95.3 | 96.8 | Non-Foaming |
| Dirty Motor Oil | Un-stable | 95.1 | 96.53 | 97.2 | 98.3 | Non-Foaming |
| Mechanical Grease | Un-stable | 96.2 | 97.8 | 98.1 | 98.7 | Non-Foaming |

At a low non-ionic level, the formulation was unstable and that why the formulation was not tested for cleaning performance. Even at 25% Non-ionic level, the viscosity was very high, and it cannot be foam. With increase level of non-ionic, improvement observed on cleaning performance.

Example 5: Effect of Anionic Surfactant

The amount of anionic surfactant present in the formulation will dictate the stability of the product as well as the cleaning efficacy. At a lower anionic level, the product will be unstable, which means, it will not be able to emulsify the solvents and at a very high anionic content, the viscosity of the formulation will be so high that it will not be able to foam. Compositions were made at different anionic level to check the efficacy.

| | Comparative 10 | Invention F | Invention E | Invention A | Invention G | Comparative 11 |
|---|---|---|---|---|---|---|
| Tergitol (15-S-7) | 7.50 | 7.50 | 7.50 | 7.50 | 7.50 | 7.50 |
| Sodium lauryl ether sulphate | 0.00 | 0.50 | 1.00 | 2.00 | 5.00 | 10.00 |
| Hexyl Carbitol | 5.00 | 5.00 | 5.00 | 5.00 | 5.00 | 5.00 |
| Solvent-Ethyl Octanoate | 2.50 | 2.50 | 2.50 | 2.50 | 2.50 | 2.50 |
| Citric Acid | 0.12 | 0.12 | 0.12 | 0.12 | 0.12 | 0.12 |
| Sodium Citrate | 0.38 | 0.38 | 0.38 | 0.38 | 0.38 | 0.38 |
| Dequest 2010 | 1.00 | 1.00 | 1.00 | 1.00 | 1.00 | 1.00 |
| Water | 83.50 | 83.00 | 82.50 | 81.50 | 78.50 | 73.50 |

The viscosity and pH of the formulations were measured along with foaming behaviour. The data is given below.

| | Comparative 10 | Invention F | Invention E | Invention A | Invention G | Comparative 11 |
|---|---|---|---|---|---|---|
| pH | 2.9 | 3.3 | 3.4 | 2.8 | 3.0 | 3.5 |
| Viscosity (Brookfield viscometer, Spindle S02) | 8 cP | 10 cP | 11 cP | 11 cP | 91 cP | 213 cP |
| Foamability | Unstable | Yes | Yes | Yes | Yes | Non-foaming |
| Foam Density | NA | <0.4 | <0.4 | <0.4 | <0.4 | Non-foaming |

The formulations were directly applied onto the stain and then those were washed as per the protocol given above. After cleaning, the L, a, b values were taken, and SRI values were given in below table.

| | Comparative 10 | Invention F | Invention E | Invention A | Invention G | Comparative 11 |
|---|---|---|---|---|---|---|
| Cooking Oil | Un-stable | 92.1 | 93.7 | 94.53 | 95.8 | Non-Foaming |
| Dirty Motor Oil | Un-stable | 90.1 | 92.4 | 96.53 | 97.8 | Non-Foaming |
| Mechanical Grease | Un-stable | 91.1 | 93.4 | 97.8 | 98.9 | Non-Foaming |

As expected, at a low anionic content, the formulation is unstable. However, the performance increases with increase in anionic content. But at a very high anionic content, the formulation cannot be foamed due to very high viscosity.

Example 6: Effect of Glycol Ether

The amount of glycol ether present in the formulation will dictate the stability of the product as well as the cleaning efficacy. At a low glycol ether, the cleaning efficacy is lower however at higher glycol ether, the foam density is higher.

| | Comparative 4 | Invention I | Invention A | Invention H | Comparative 13 |
|---|---|---|---|---|---|
| Tergitol (15-S-7) | 7.50 | 7.50 | 7.50 | 7.50 | 7.50 |
| Sodium lauryl ether sulphate | 2.00 | 2.00 | 2.00 | 2.00 | 2.00 |
| Hexyl Carbitol | 0.00 | 2.00 | 5.00 | 10.00 | 20.00 |
| Solvent-Ethyl Octanoate | 2.50 | 2.50 | 2.50 | 2.50 | 2.50 |
| Citric Acid | 0.12 | 0.12 | 0.12 | 0.12 | 0.12 |
| Sodium Citrate | 0.38 | 0.38 | 0.38 | 0.38 | 0.38 |
| Dequest 2010 | 1.00 | 1.00 | 1.00 | 1.00 | 1.00 |
| Water | 86.50 | 84.50 | 81.50 | 76.50 | 66.50 |

The viscosity and pH of the formulations were measured along with foaming behaviour. The data is given below.

| | Comparative 4 | Invention I | Invention A | Invention H | Comparative 13 |
|---|---|---|---|---|---|
| pH | 2.8 | 2.9 | 2.8 | 2.8 | 3.0 |
| Viscosity (Brookfield viscometer, Spindle S02) | 11 cP | 10 cP | 11 cP | 11 cP | 15 cP |

-continued

| | Comparative 4 | Invention I | Invention A | Invention H | Comparative 13 |
|---|---|---|---|---|---|
| Foamability | yes | Yes | Yes | Yes | Non-foaming |
| Foam Density | <0.4 | <0.4 | <0.4 | <0.4 | >0.4 |

The formulations were directly applied onto the stain and then those were washed as per the protocol given above. After cleaning, the L, a, b values were taken, and SRI values were given in below table.

| | Comparative 4 | Invention I | Invention A | Invention H | Comparative 13 |
|---|---|---|---|---|---|
| Cooking Oil | 91.22 | 92.1 | 94.53 | 96.7 | Non-Foaming |
| Dirty Motor Oil | 92.22 | 93.5 | 96.53 | 98.4 | Non-Foaming |
| Mechanical Grease | 94.1 | 95.8 | 97.8 | 99.1 | Non-Foaming |

With increase in glycol ether, the cleaning efficacy increases. However, at a very high level, the formulation did not foam. The foam was more water like.

Example 7: Effect of Fatty Acid Ester

The amount of fatty acid ester present in the formulation will dictate the stability of the product as well as the cleaning efficacy. At a low fatty acid ester amount, the cleaning efficacy is lower however at higher wt. %, the formulation will be unstable due to presence of more hydrophobic ingredients.

| | Comparative 03 | Invention J | Invention A | Invention K | Comparative 14 |
|---|---|---|---|---|---|
| Tergitol (15-S-7) | 7.50 | 7.50 | 7.50 | 7.50 | 7.50 |
| Sodium lauryl ether sulphate | 2.00 | 2.00 | 2.00 | 2.00 | 2.00 |
| Hexyl Carbitol | 5.00 | 5.00 | 5.00 | 5.00 | 5.00 |
| Solvent-Ethyl Octanoate | 0.00 | 1.00 | 2.50 | 4.00 | 10.00 |
| Citric Acid | 0.12 | 0.12 | 0.12 | 0.12 | 0.12 |
| Sodium Citrate | 0.38 | 0.38 | 0.38 | 0.38 | 0.38 |
| Dequest 2010 | 1.00 | 1.00 | 1.00 | 1.00 | 1.00 |
| Water | 84.00 | 83.00 | 81.50 | 80.00 | 74.00 |

The viscosity and pH of the formulations were measured along with foaming behaviour. The data is given below.

| | Comparative 03 | Invention J | Invention A | Invention K | Comparative 14 |
|---|---|---|---|---|---|
| pH | 2.8 | 2.6 | 2.8 | 3.0 | 3.2 |
| Viscosity (Brookfield viscometer, Spindle S02) | 12 cP | 10 cP | 11 cP | 11 cP | 15 cP |
| Foamability | yes | Yes | Yes | Yes | Unstable |
| Foam Density | <0.4 | <0.4 | <0.4 | <0.4 | Unstable |

The formulations were directly applied onto the stain and then those were washed as per the protocol given above. After cleaning, the L, a, b values were taken, and SRI values were given in below table.

| | Comparative 03 | Invention J | Invention A | Invention K | Comparative 14 |
|---|---|---|---|---|---|
| Cooking Oil | 88.7 | 92.1 | 94.53 | 96.7 | Unstable |
| Dirty Motor Oil | 90.1 | 93.6 | 96.53 | 98.6 | Unstable |

-continued

| | Comparative 03 | Invention J | Invention A | Invention K | Comparative 14 |
|---|---|---|---|---|---|
| Mechanical Grease | 84.5 | 90.5 | 97.8 | 98.9 | Unstable |

The effect of fatty acid ester on cleaning is very high. When there is no fatty acid ester present, the cleaning is poor. However, with increase in fatty acid ester, the cleaning efficacy increases. But at 10% level, the formulation is unstable due to less amount of emulsifier present.

Example 8: Effect of Hydrogen Peroxide

The formulation was found to be stable with hydrogen peroxide. To check the efficacy of the formulation in presence of hydrogen peroxide, formulations were prepared, and cleaning efficacy was tested as per the given protocol.

| | | Invention A | Invention L |
|---|---|---|---|
| Non-Ionic Surfactant | Tergitol (15-S-7) | 7.5 | 7.5 |
| Anionic Surfactant | Sodium lauryl ether sulphate | 2 | 2 |
| Water Miscible solvent | Hexyl Carbitol | 5 | 5 |
| Water Immiscible solvent | Solvent-Ethyl Octanoate | 2.5 | 2.5 |
| Buffer | Citric Acid | 0.12 | 0.12 |
| Buffer | Sodium Citrate | 0.38 | 0.38 |
| Sequestrant | Dequest 2010 | 1 | 1 |
| Bleach | Hydrogen peroxide | 0 | 8 |
| | Water | 81.5 | 73.5 |

The dosage, viscosity and pH values are given below.

| | Invention A | Invention L |
|---|---|---|
| Dosage | 0.4 ml | 0.4 ml |
| Viscosity (Brookfield Viscometer, Spindle S02) | 11 cP | 15 cP |
| pH | 2.8 | 3.1 |
| Foamability | Yes | Yes |
| Foam Density | <0.4 | <0.4 |

The cleaning efficacy of those formulations were tested against vanish. For that, 0.4 ml of Invention A & L, were applied onto the stain. 5 min of aging time was provided before putting those into the washing machine. Standard detergent powder (surf excel quick wash) was used at 1.5 gpl product dosage. The washing was carried out in normal fuzzy wash cycle. After washing the test fabrics were dried in dark room and L, a, b values were measured, and SRI was calculated based on the equation provided above.

| | Invention A | Invention L |
|---|---|---|
| Cooking Oil | 94.53 | 95.4 |
| Dirty Motor Oil | 96.53 | 97.5 |
| Mechanical Grease | 97.8 | 98.9 |
| Black Tea | 94.09 | 98.1 |
| Blood | 81.5 | 95.3 |
| Grape Juice | 88.7 | 96.7 |

The formulation with hydrogen peroxide showed superior performance also in bleachable stain cluster.

The invention claimed is:

1. A foamable, liquid cleaning composition comprising:

0.5 to 5 wt. % $C_{8-18}$ alkoxylated anionic surfactant having 1 to 30 moles of alkylene oxide;

5 to 20 wt. % nonionic surfactants;

0.1 to 10 wt. % water miscible glycol ether solvent;

0.1 to 10 wt. % water immiscible fatty acid ester solvent selected from the group consisting of methyl laurate, ethyl laurate, ethyl octanoate or mixtures thereof;

0.5 to 10% of sequestrant selected from the group consisting of citric, adipic, succinic, maleic, glutaric acids, mixtures thereof or salts thereof; and water;

wherein the foamable liquid cleaning composition has a viscosity of less than 100 mPa·s at 25° C. and 20 $s^{-1}$, wherein ratio of the sum of alkoxylated surfactant and nonionic surfactant to the solvent is in a weight ratio ranging from 0.93:1 to 20:1, and wherein the pH of the foamable liquid cleaning composition ranges from 2.0 to 4.5.

2. A composition according to claim 1, wherein the amount of water miscible glycol ether solvent is from 0.66 to 10 wt. % of the foamable liquid cleaning composition.

3. A composition according to claim 1, wherein the amount of water immiscible fatty acid ester solvent is from 0.33 wt. % to 5 wt. % of the foamable liquid cleaning composition.

4. A composition according to claim 1 further, comprising an amphoteric surfactant selected from amine oxide, betaine or combinations thereof.

5. A composition according to claim 1, wherein the non-ionic surfactant is an alkoxylated linear alcohol.

6. A composition according to claim 1, wherein the foamable liquid cleaning composition contains at least 12 wt. % of water.

7. A composition according to claim 1 further comprising at least 2 wt. % hydrogen peroxide.

8. A composition according to claim 1 wherein the foamable liquid cleaning composition further comprises:

a buffering agent, wherein the buffering agent comprises a carboxylic acid and a base selected from ammonium or alkali metal hydroxides and/or organic amines.

9. A cleaning system comprising:
a spraying device,
wherein the spraying device comprises
a container,
wherein the container is configured to hold a foamable liquid cleaning composition comprising:
0.5 to 5 wt. % $C_{8-18}$ alkoxylated anionic surfactant having 1 to 30 moles of alkylene oxide,
5 to 20 wt. % nonionic surfactants,
0.1 to 10 wt. % water miscible glycol ether solvent,
0.1 to 10 wt. % water immiscible fatty acid ester solvent selected from the group consisting of methyl laurate, ethyl laurate, ethyl octanoate or mixtures thereof,
0.5 to 10% of sequestrant selected from the group consisting of citric, adipic, succinic, maleic, glutaric acids, mixtures thereof or salts thereof, and
water,
a spray head, and
a liquid supply arrangement,
wherein the liquid supply arrangement configured to transfer the foamable liquid cleaning composition from the container to the spray head and forming a foam with a density of less than 0.4 g/ml when ejected from the spray device through the spray head.

10. A cleaning system according to claim 9, wherein the spraying device is selected from a trigger spray foam bottle, a squeeze foam bottle and a foam pump.

11. A method of removing oily fatty stains from fabric, the method comprising the steps of:
providing a fabric;
pre-treating the fabric by applying a foamable liquid cleaning composition according to claim 1 as a foam onto the surface of the fabric;
washing the pre-treated fabric; and
drying the washed fabric.

12. A method of removing oily fatty stains from fabric comprising:
obtaining a foamable liquid cleaning composition comprising:
0.5 to 5 wt. % $C_{8-18}$ alkoxylated anionic surfactant having 1 to 30 moles of alkylene oxide;
5 to 20 wt. % nonionic surfactants;
0.1 to 10 wt. % water miscible glycol ether solvent;
0.1 to 10 wt. % water immiscible fatty acid ester solvent selected from the group consisting of methyl laurate, ethyl laurate, ethyl octanoate or mixtures thereof;
0.5 to 10% of sequestrant selected from the group consisting of citric, adipic, succinic, maleic, glutaric acids, mixtures thereof or salts thereof; and
water; and
applying a sufficient amount of the foamable liquid cleaning composition in the form of a foam onto the surface of a fabric so as to result in removal of oily fatty stains from the surface of the fabric.

* * * * *